US011819089B2

(12) United States Patent
Hatano et al.

(10) Patent No.: US 11,819,089 B2
(45) Date of Patent: Nov. 21, 2023

(54) FASTENING STRUCTURE OF UPPER OF SHOE AND SHOE

(71) Applicant: ASICS Corporation, Hyogo (JP)

(72) Inventors: Genki Hatano, Hyogo (JP); Shingo Takashima, Hyogo (JP); Kenta Moriyasu, Hyogo (JP); Satoru Abe, Hyogo (JP); Hiroaki Nishimura, Hyogo (JP); Tomoki Ishizashi, Hyogo (JP)

(73) Assignee: ASICS CORPORATION, Hyogo (JP)

( * ) Notice: Subject to any disclaimer, the term of this patent is extended or adjusted under 35 U.S.C. 154(b) by 399 days.

(21) Appl. No.: 17/312,719

(22) PCT Filed: Dec. 17, 2018

(86) PCT No.: PCT/JP2018/046294
§ 371 (c)(1),
(2) Date: Jun. 10, 2021

(87) PCT Pub. No.: WO2020/129117
PCT Pub. Date: Jun. 25, 2020

(65) Prior Publication Data

US 2022/0015507 A1 Jan. 20, 2022

(51) Int. Cl.
*A43C 5/00* (2006.01)
*A43B 23/02* (2006.01)

(52) U.S. Cl.
CPC ..... *A43C 5/00* (2013.01); *A43B 23/0245* (2013.01)

(58) Field of Classification Search
CPC ..... A43C 5/00; A43C 1/003; A43B 23/0245; A43B 23/0265; A43B 23/0235
See application file for complete search history.

(56) References Cited

U.S. PATENT DOCUMENTS 4,780,969 A * 11/1988 White, Jr. ..... A43B 11/00 36/114
8,826,568 B1 * 9/2014 Flatley ..... A43C 1/04 24/715.1

(Continued)

FOREIGN PATENT DOCUMENTS

JP 01-139710 U 9/1989
JP 4957978 B2 6/2012

OTHER PUBLICATIONS

International Search Report issued in corresponding International Patent Application No. PCT/JP2018/046294, dated Mar. 12, 2019, with English translation.

*Primary Examiner* — David M Upchurch
(74) *Attorney, Agent, or Firm* — McDermott Will & Emery LLP

(57) ABSTRACT

A fastening structure of the present upper includes: an upper that defines a left eyelet row and a right eyelet row arranged along a longitudinal direction of a shoe; and a shoelace inserted through eyelets of the left and right eyelet rows, wherein: the left and right eyelet rows each at least include a first eyelet on a tip side, and a second eyelet, a third eyelet and a fourth eyelet that are arranged in this order from the first eyelet toward a posterior side; $D_1$ is defined as a first average interval between eyelets; $D_2$ is defined as a second average interval; $D_3$ is defined as a third average interval; and Expressions (1) and (10) below are satisfied:

$$D_1>D_2<D_3 \quad (1)$$

$$1.0*(D_1+D_2)>D_1>0.6*(D_1+D_2) \quad (10).$$

16 Claims, 8 Drawing Sheets

(56) References Cited

U.S. PATENT DOCUMENTS

| | | | | |
|---|---|---|---|---|
| 2011/0099843 | A1 | 5/2011 | Jung | |
| 2015/0026937 | A1* | 1/2015 | Nonogawa | A43C 1/00 24/713.6 |
| 2015/0096193 | A1* | 4/2015 | Senegal | A43C 1/003 36/51 |
| 2020/0170349 | A1* | 6/2020 | Verfl | A43B 23/0275 |

* cited by examiner

FIG. 7B : PRIOR ART

FASTENING STRUCTURE OF UPPER OF SHOE AND SHOE

CROSS REFERENCE TO RELATED APPLICATIONS

This application is the U.S. National Phase under 35 U.S.C. § 371 of International Application No. PCT/JP2018/046294, filed on Dec. 17, 2018, the entire contents of each are hereby incorporated by reference.

TECHNICAL FIELD

The present invention relates to a fastening structure of an upper of a shoe, and a shoe.

BACKGROUND ART

Eyelets for inserting a shoelace are typically arranged left-right symmetrical and evenly spaced. Various proposals have been made in order to improve the fitting property of the upper to the foot (see, for example, the first patent document (FIG. 12) and the second patent document (FIG. 1)).

CITATION LIST

Patent Document

[FIRST PATENT DOCUMENT] Japanese Patent No. 4957978

[SECOND PATENT DOCUMENT] Examined Utility Model Application Publication No. H01-139710

SUMMARY OF INVENTION

These documents disclose shoes having a partially widened interval between eyelets in each of the left and right eyelet rows.

These documents, however, fail to disclose improvement in the fitting property by the uneven interval setting.

One preferred aspect of the present invention is to improve the fitting property of the upper through the setting of eyelet intervals in the left and right eyelet rows.

Prior to describing the configuration of the present invention, the principle of the present invention will be described with reference to FIG. 7B. This figure shows a schematic plan view of eyelets and a shoelace.

FIG. 7B shows a typical example where eyelets are arranged equidistantly. In this figure, a shoelace 40 is inserted alternately through eyelets $HL_1$ to $HL_n$ of the left-side eyelet row and eyelets $HR_1$ to $HR_n$ of the right-side eyelet row in a crisscross pattern. The shoelace 40 through the eyelets imparts, on the upper, tensions T, T to be the source of the fastening force $F_i$ in the foot width direction.

The fastening force $F_i$ at each eyelet is given by Expression (100) below.

$$F_i = T^*\cos\theta_{i1} + T^*\cos\theta_{i2} \quad (100)$$

where $T^*\cos\theta_{i1}$ and $T^*\cos\theta_{i2}$ are each a component force of tension T in the foot width direction The sum $\Sigma F_i$ of fastening forces in the foot width direction from the shoelace 40 is the sum $\Sigma F_i = (F_1 + F_2 + \ldots + F_i + \ldots F_n)$ obtained by adding together the fastening forces $F_i$. It is believed that the greater the sum $\Sigma F_i$, the more likely the upper will fit the foot.

Now, assuming that the tension of the shoelace is uniform, the sum $\Sigma F_i$ of fastening forces increases by making the inclination angle $\theta_{i1}$ and the inclination angle $\theta_{i2}$ of FIG. 7B more acute. However, if all the inclination angles are decreased, the number of eyelets will be excessive, thereby causing trouble for the lacing operation. If the number of eyelets is kept unchanged, it is difficult to make more acute the inclination angles $\theta_{i1}$ and $\theta_{i2}$ at all eyelets by moving around the eyelet positions.

Now, if the eyelets are arranged generally evenly spaced (equidistant) as in the typical example of FIG. 7B, the fastening force $F_1$ on the anterior side is greater than the fastening force $F_j$ (j=2, 3, . . . , n−1) at other locations. On the other hand, the present inventors found that in order to fit the upper to the foot, a large fastening force is needed generally in the area corresponding to the location of the second eyelet to the third eyelet.

In one aspect, a fastening structure of the present invention is a fastening structure of an upper of a shoe, wherein:

- the upper defines a left eyelet row and a right eyelet row arranged along a longitudinal direction of the shoe;
- the left and right eyelet rows each at least include a first eyelet on a tip side, and a second eyelet, a third eyelet and a fourth eyelet that are arranged in this order from the first eyelet toward a posterior side;
- a first average interval $D_1$ is defined as an average value between an interval in the longitudinal direction between the first eyelet and the second eyelet of the left eyelet row and that of the right eyelet row;
- a second average interval $D_2$ is defined as an average value between an interval in the longitudinal direction between the second eyelet and the third eyelet of the left eyelet row and that of the right eyelet row;
- a third average interval $D_3$ is defined as an average value between an interval in the longitudinal direction between the third eyelet and the fourth eyelet of the left eyelet row and that of the right eyelet row; and Expressions (1) and (10) below are satisfied.

$$D_1 > D_2 < D_3 \quad (1)$$

$$1.0^*(D_1+D_2) > D_1 > 0.6^*(D_1+D_2) \quad (10)$$

In this aspect, the second average interval $D_2$ is smaller than the first average interval $D_1$ and the third average interval $D_3$. Therefore, as compared with a case where average intervals $D_i$ are equal, the sum $\Sigma F_i$ of fastening forces will be larger.

BRIEF DESCRIPTION OF THE DRAWINGS

FIG. 7B is a plan view showing an example of a typical eyelet arrangement.

FIG. 8A, FIG. 8B and FIG. 80 are a plan view, a lateral side view and a medial side view, respectively, of the upper, wherein the area where the fastening force is needed is represented by a dotted pattern.

DESCRIPTION OF EMBODIMENTS

Figure 7A:
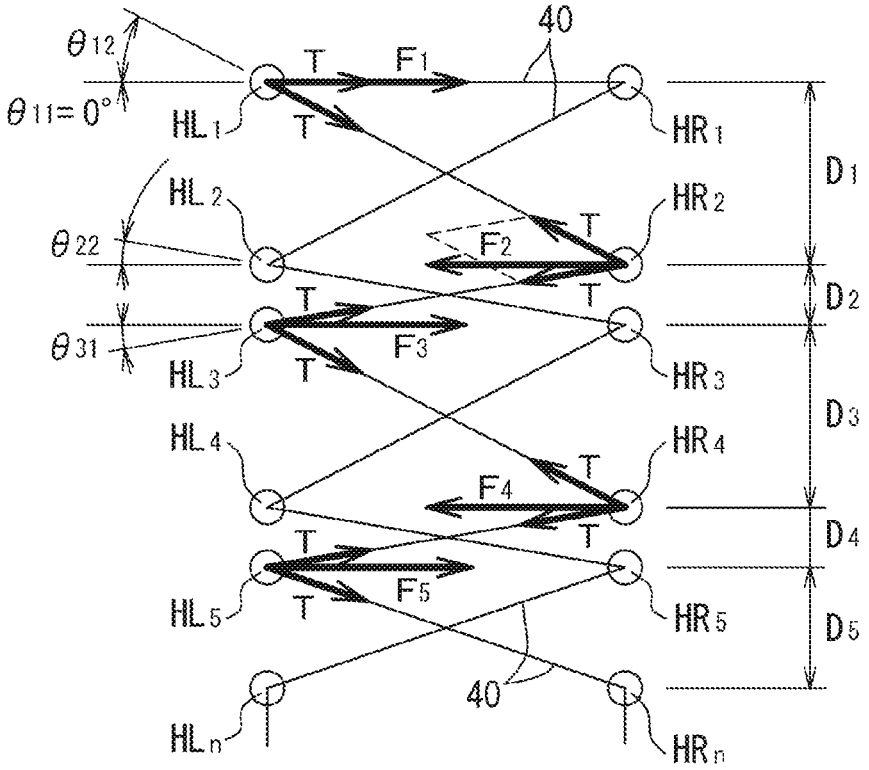
FIG. 7A is a plan view showing still another example of an eyelet arrangement.
Figure 7A:
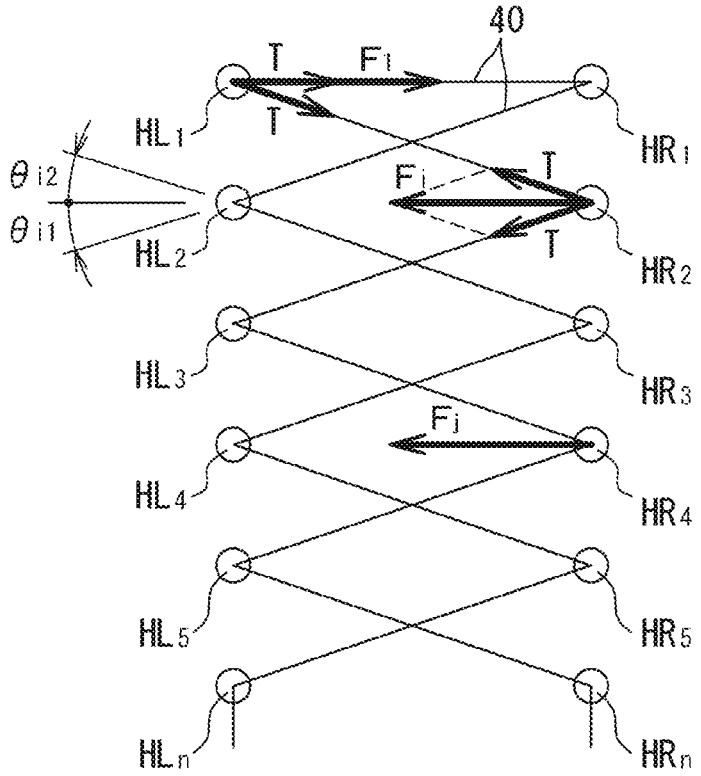

The present inventors sought for an eyelet arrangement that maximizes the sum $\Sigma F_i$ where the distance from the eyelet $HL_1$, $HR_1$ on the anterior side to the eyelet $HL_n$, $HR_n$ on the posterior side is generally constant and the number of eyelets is constant. As a result, the present inventors found that the sum $\Sigma F_i$ is maximized when the average intervals $D_1$ to $D_n$ between eyelets of each eyelet row are alternately large and small as shown in FIG. 7A, and made further in-depth studies to arrive at the present invention.

In a preferred embodiment of the present invention, the first average interval $D_1$ is defined as an average value between an interval in the longitudinal direction between the first eyelet and the second eyelet of the left eyelet row and that of the right eyelet row; the second average interval $D_2$ is defined as an average value between an interval in the longitudinal direction between the second eyelet and the third eyelet of the left eyelet row and that of the right eyelet row; and the third average interval $D_3$ is defined as an average value between an interval in the longitudinal direction between the third eyelet and the fourth eyelet of the left eyelet row and that of the right eyelet row; and Expressions (1) and (10) below are satisfied.

$$D_1>D_2<D_3 \quad (1)$$

$$1.0*(D_1+D_2)>D_1>0.6*(D_1+D_2) \quad (10)$$

In this case, the second average interval $D_2$ between the first average interval $D_1$ and the third average interval $D_3$ is small, and the average intervals are alternately large and small, which can increase the total fastening. Therefore, it is possible to improve the fitting property.

As shown in Expression (10) above, the second average interval $D_2$ is smaller than the first average interval $D_1$. Therefore, the sum $\Sigma F_i$ of fastening forces increases as compared with a case where the average intervals $D_i$ are equal. This increases the fastening force at the second eyelet, where a large fastening force is needed, and it is possible to improve the fitting property.

Preferably, as shown in Expression (30) below, the third average interval $D_3$ is set to a value that is greater than 0.65 times ($D_3$+$D_4$ (fourth average interval)). This increases the sum $\Sigma F_i$ of the fastening force as compared with a case where $D_3$=$D_4$, as will be described below.

More preferably, Expression (5) below is further satisfied.

$$1.0*(D_2+D_3)>D_3>0.65*(D_2+D_3) \quad (5)$$

In this expression, the third average interval $D_3$ of FIG. 7A (a schematic plan view showing eyelets and a shoelace) is set to a value that is greater than at least 0.6 times ($D_2$+$D_3$). Thus, the second to fourth eyelets will not be too close to each other, and it is possible to prevent the fastening force from being lopsided, as will be described below.

Note that also in FIG. 7A, as in FIG. 7B, the fastening force $F_i$ at each eyelet is given by Expression (100) above.

Preferably, the left and right eyelet rows each further include a fifth eyelet posterior to the fourth eyelet; a fourth average interval $D_4$ is defined as an average value between an interval in the longitudinal direction between the fourth eyelet and the fifth eyelet of the left eyelet row and that of the right eyelet row; and Expression (6) below is satisfied.

$$D_1>D_4<D_3 \quad (6)$$

In this case, the fourth average interval $D_4$ is smaller than the first average interval $D_1$ and the third average interval $D_3$, which can increase the total fastening. Therefore, it is possible to improve the fitting property.

Preferably, Expression (7) below is further satisfied.

$$(D_1+D_2)>(D_3+D_4) \quad (7)$$

A plurality of tendons extend along the longitudinal direction near the surface of the instep. These tendons rise when the toes are flexed. If the upper hinders this rise, it prevents smooth flexing of the foot. Particularly, the extensor hallucis longus tendon rises significantly above the MP joint. Therefore, it is preferred that the eyelets are arranged with a greater average interval between the first to third eyelets, which is located close to the MP joint, than between the third to fifth eyelets, which is remote from the MP joint.

That is, if the eyelets are arranged according to Expression (7) above, the fastening force at the first to third eyelets arranged with a large average interval is less likely to hinder the flexing of the foot, and it is therefore likely to realize smooth flexing of the foot while maintaining a high fitting property.

As will be described below, if the fourth average interval $D_4$ is set to be sufficiently smaller than the second average interval $D_2$, the fastening force may further increase.

Therefore, it is preferred that Expression (8) or (9) below is satisfied.

$$D_4<D_2 \quad (8)$$

$$(D_2/D_1)>(D_4/D_3) \quad (9)$$

That is, depending on the application, the fastening force may be configured to be higher in the vicinity of the middle foot portion than the tip, as shown in Expression (9) above.

Conversely, depending on the application, the fastening force may be configured to be higher in the vicinity of the tip than the middle foot portion, as shown in Expression (9') below.

$$(D_2/D_1)<(D_4/D_3) \quad (9')$$

Preferably, the fourth eyelet and the fifth eyelet are spaced apart from each other in a foot width direction, and an interval $W_4$ between the fourth eyelet and the fifth eyelet in the foot width direction is greater than the fourth average interval $D_4$.

If the fourth average interval $D_4$ is decreased, the distance between eyelets may be too small, thereby partially lowering the strength of the upper, and making it more likely for the upper to rip due to the fastening force. For this, the ripping can be prevented by increasing the interval $W_4$ in the foot width direction between the fourth eyelet and the fifth eyelet.

Any feature illustrated and/or depicted in conjunction with one of the aforementioned aspects or the following embodiments may be used in the same or similar form in one or more of the other aspects or other embodiments, and/or may be used in combination with, or in place of, any feature of the other aspects or embodiments.

Embodiments

The present invention will be understood more clearly from the following description of preferred embodiments taken in conjunction with the accompanying drawings. Note however that the embodiments and the drawings are merely illustrative and should not be taken to define the scope of the present invention. The scope of the present invention shall be defined only by the appended claims. In the accompanying drawings, like reference numerals denote like components throughout the plurality of figures.

Embodiments of the present invention will now be described with reference to the drawings.

Figure 1A:
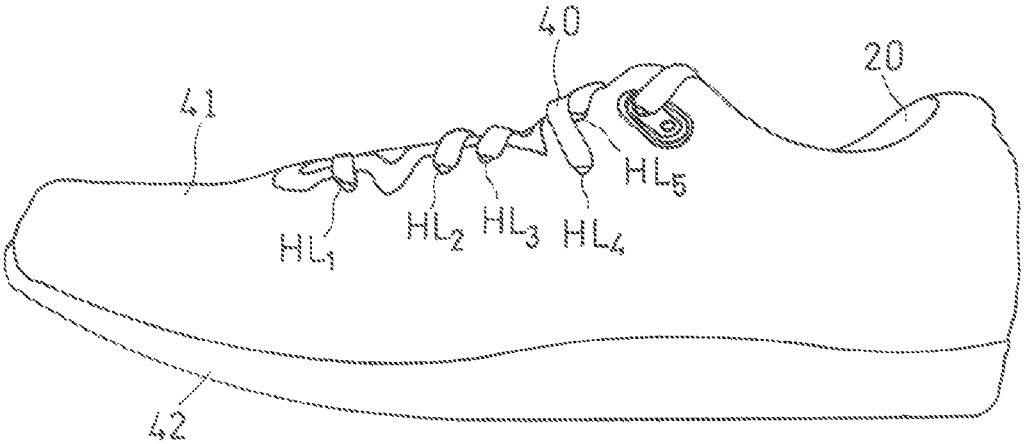
FIG. 1A is a left side view of a shoe according to one embodiment of the present invention.
Figure 1B:
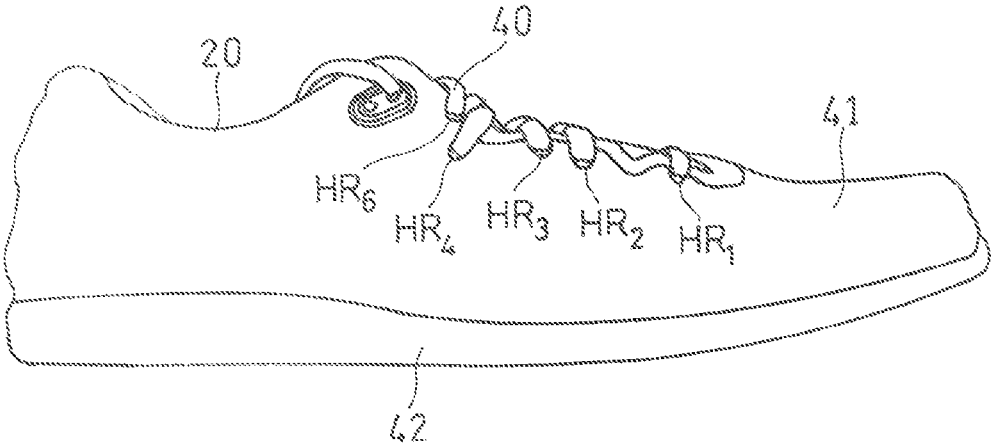
FIG. 1B is a right side view.

In FIG. 1A and FIG. 1B, the shoe includes an upper 41 that is integral with a sole 42 and the shoelace 40. The upper is provided with an opening 20 for inserting the foot. While this shoe is used for an athletic shoe, for example, the present invention is not limited to this. The shoelace 40 may be removably provided on the upper 41.

Figure 2:
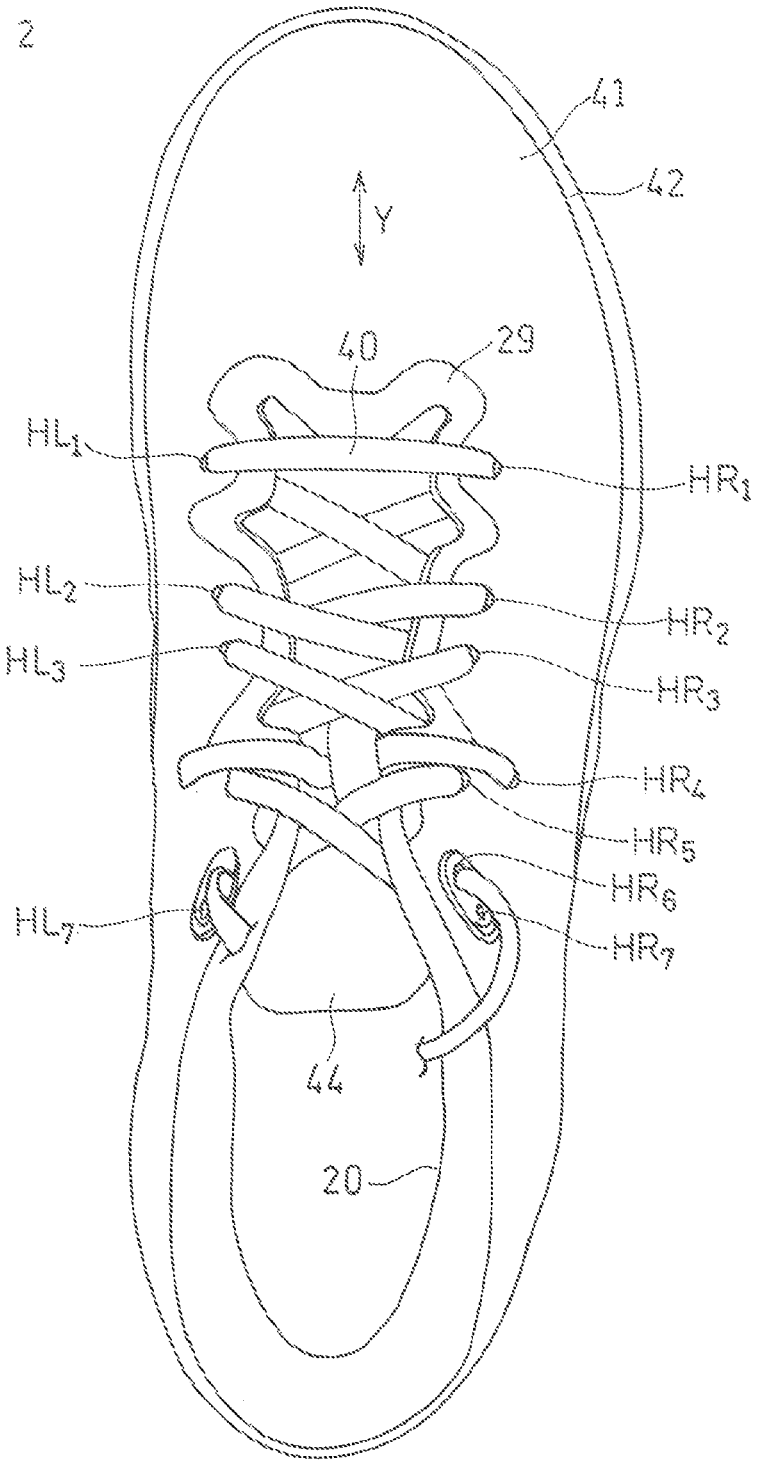
FIG. 2 is a plan view of a shoe.
Figure 4:
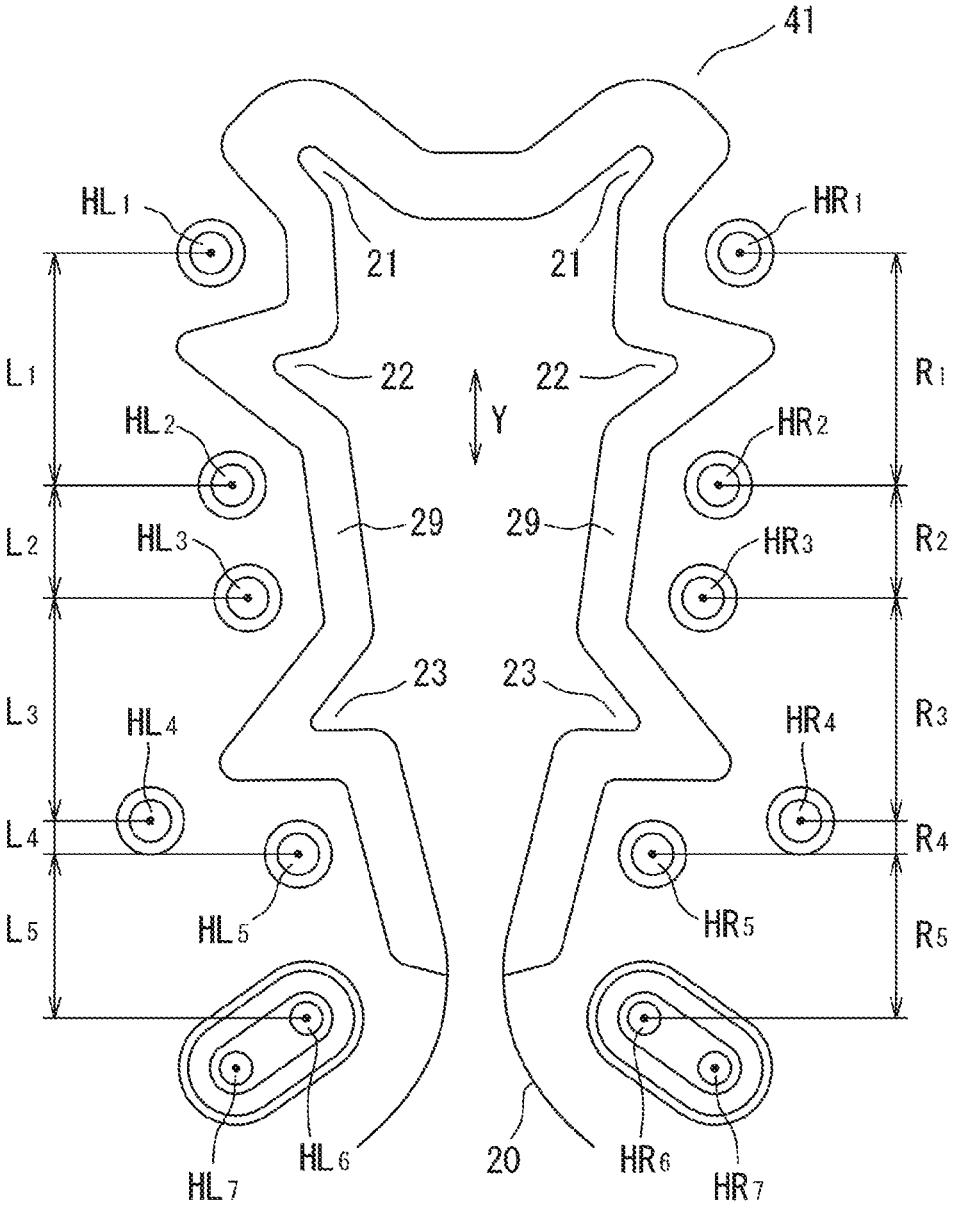
FIG. 4 is an enlarged plan view showing an arrangement of eyelets of the upper.

In FIG. 2, the upper 41 defines a left eyelet row and a right eyelet row arranged along the longitudinal direction Y of the shoe. As shown in FIG. 4, each eyelet row is composed of a plurality of eyelets $HL_i$, $HR_i$. Herein, left and right means these directions as seen from the wearer, and for the shoe for the right foot, left means the medial side and right means the lateral side as shown in FIG. 2. Similarly, for the shoe for the left foot, right means the medial side and left means the lateral side.

As shown in FIG. 2 (and FIG. 7A), the shoelace 40 is inserted alternately through eyelets of the left eyelet row and eyelets of the right eyelet row in a crisscross pattern. In the case of this example, the shoelace 40 is strung in a horizontal straight line pattern on the tip side of the shoe, and is strung in a horizontally-elongated X-shaped pattern posterior thereto. That is, the shoelace 40 may be laced with an overlapping method or an underlapping method, or a mixture of an overlapping method and an underlapping method.

The shoelace 40 engages with the upper 41 at the eyelets for pulling together the left side (the medial side) of the upper and the right side (the lateral side) of the upper, and fitting the side foot portions of the upper to the foot.

While eyelets are through holes formed in the upper in this example, eyelets may be rings attached to the through holes. Alternatively, eyelets may be loops or U-shaped metals.

Figure 3:
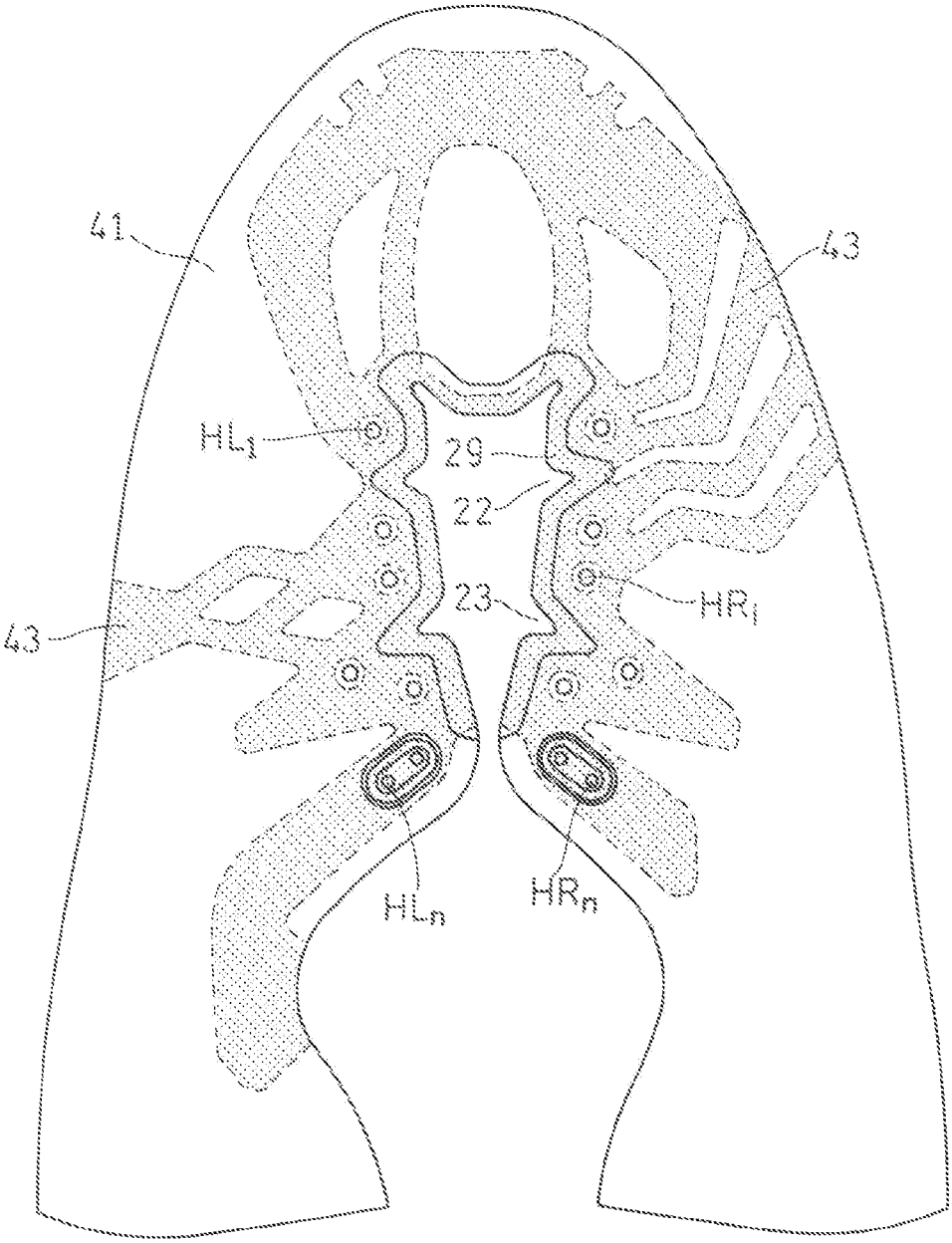
FIG. 3 is a plan view of an upper before being molded.
Figure 5A:
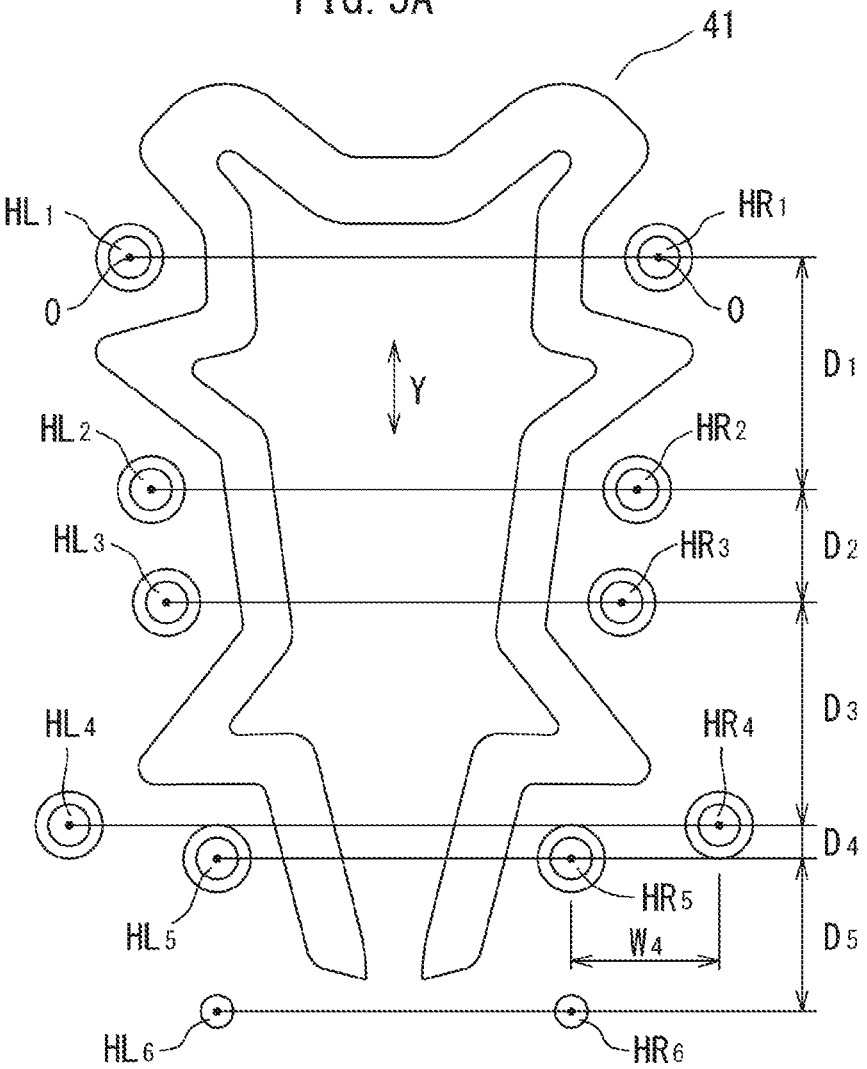
FIG. 5A is an enlarged plan view showing an arrangement of eyelets of the upper.

FIG. 3 shows the upper before being three-dimensionally shaped into the upper 41 as shown in FIG. 2, and FIG. 4 and FIG. 5A show partial enlarged views thereof.

In the present fastening structure of FIG. 4, the left and right eyelet rows each include a first eyelet $HL_1$, $HR_1$ on the tip side of the shoe, and a second eyelet $HL_2$, $HR_2$, a third eyelet $HL_3$, $HR_3$, a fourth eyelet $HL_4$, $HR_4$, a fifth eyelet $HL_5$, $HR_5$ and a sixth eyelet $HL_6$, $HR_6$ that are arranged in this order from the first eyelet $HL_1$, $HR_1$ toward the posterior side, and in this example further include a seventh eyelet $HL_7$, $HR_7$.

In the case of an athletic shoe, the number of eyelets is in many cases six for each of the left and right eyelet rows and, accordingly, the number of eyelets may be six for each of the left and right eyelet rows. The number of eyelets may be four on each side. When it is seven on each side, it is often the case that the shoelace 40 is not inserted through the seventh eyelets.

In FIG. 5A, the value obtained by averaging the intervals in the longitudinal direction Y between the $i^{th}$ eyelets $HL_i$, $HR_i$ and the $i+1^{th}$ (next posterior) eyelets $HL_{i+1}$, $HR_{i+1}$ for the left and right eyelet rows is denoted as the average interval $D_1$.

That is, it is expressed as follows.

First average interval $D_1$: the value obtained by averaging the intervals in the longitudinal direction Y between the first eyelets $HL_1$, $HR_1$ and the second eyelets $HL_2$, $HR_2$ for the left and right eyelet rows.

Second average interval $D_2$: the value obtained by averaging the intervals in the longitudinal direction Y between the second eyelets $HL_2$, $HR_2$ and the third eyelets $HL_3$, $HR_3$ for the left and right eyelet rows.

Third average interval $D_3$: the value obtained by averaging the intervals in the longitudinal direction Y between the third eyelet $HL_3$, $HR_3$ and the fourth eyelet $HL_4$, $HR_4$ for the left and right eyelet rows.

Fourth average interval $D_4$: the value obtained by averaging the intervals in the longitudinal direction Y between the fourth eyelet $HL_4$, $HR_4$ and the fifth eyelet $HL_5$, $HR_5$ for the left and right eyelet rows.

Herein, while the longitudinal direction Y may be considered as the longitudinal direction of the shoe, it only means the front-rear direction of the shoe in the present invention, and the direction does not need to be strictly defined. The reason is as follows.

As shown in FIG. 4, in the case of this example, the left and right eyelet rows are arranged in line symmetry with each other. Therefore, the eyelet interval $L_i$ between any eyelet $HL_i$ and the next posterior eyelet $HL_{i+1}$ of the left row is equal to the eyelet interval R between the eyelet HR and the next posterior eyelet $HR_{i+1}$ of the right row.

On the other hand, the present invention is defined by the differences or the ratio between the average intervals $D_1$ to $D_4$ of FIG. 5A, and what matters is therefore the relative values of or the relative ratios between eyelet intervals rather than the absolute values of the eyelet intervals themselves. Thus, the longitudinal direction Y does not need to be uniquely defined, but may be defined to be a certain direction. For example, distances between straight lines each passing through the center points O of the left and right $i^{th}$ eyelets may be used as the average intervals $D_1$ to $D_4$ as shown in FIG. 5A of this example.

Figure 6:
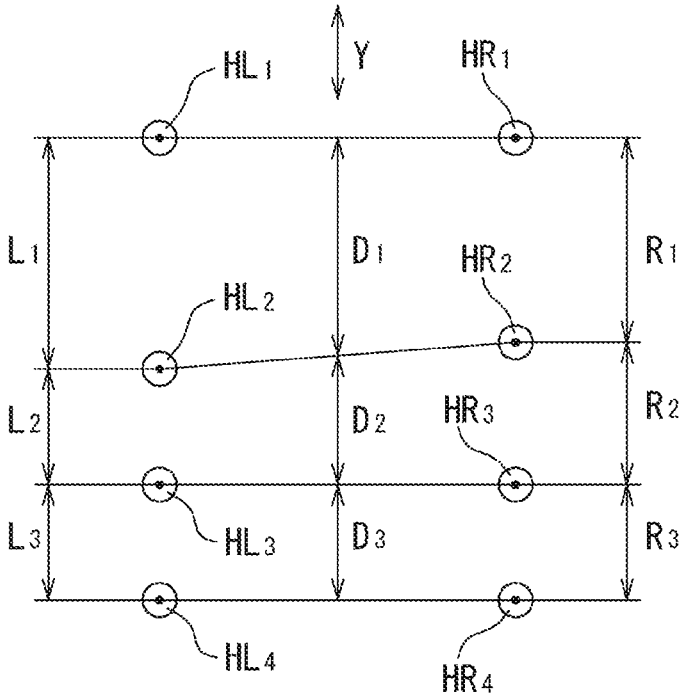
FIG. 6 is a plan view showing another example of an eyelet arrangement.

On the other hand, this similarly applies also to a case where the left and right eyelet rows are asymmetric with each other as shown in the example of FIG. 6.

In FIG. 6, an average interval $D_i$ is represented as the average value between the eyelet intervals $L_i$ and $R_i$.

That is, $D_1$ to $D_3$ are represented as shown in expressions below.

$$D_1=(L_1+R_1)/2$$

$$D_2=(L_2+R_2)/2$$

$$D_3=(L_3+R_3)/2$$

In other words, the $i^{th}$ average interval a is represented as the average value between the interval $L_i$ in the longitudinal direction Y between the left-side $i^{th}$ eyelet $HL_i$ and the left-side $(i+1)^{th}$ (next posterior) eyelet $HL_{i+1}$ and the interval $R_i$ in the longitudinal direction between the right-side $i^{th}$ eyelet $HR_i$ and the right-side $(i+1)^{th}$ (next posterior) eyelet $HR_{i+1}$.

Another method for obtaining the average interval a of a final product of a shoe as shown in FIG. 1A, FIG. 1B and FIG. 2 will be described.

In such a case, for the left-side eyelet row of eyelets $HL_i$ of FIG. 2, the eyelet intervals $L_1$ to $L_5$ (FIG. 4) along the longitudinal direction Y are obtained. Then, for the right-side eyelet row of eyelet $HR_i$ of FIG. 2, the eyelet intervals $R_1$ to $R_5$ of FIG. 4 along the longitudinal direction Y are obtained.

Then, the average value between the eyelet intervals $L_i$ and $R_i$ is obtained as shown in the expression below.

$$D_i=(L_i+R_i)/2$$

Note that as the method for obtaining intervals $L_i$ and $R_i$ and the average interval $D_i$ between eyelets of the final product of FIG. 2, etc., or the upper shown flattened in FIG. 3, one may capture an image of the shoe or the upper from directly above or from a forward and upward diagonal direction and then measure the intervals on the captured image.

Next, the order among and the ratio between the average intervals $D_1$ to $D_4$ of FIG. 5A will be described.

In the example of FIG. 5A, Expressions (1), (6), (10) and (30) below are satisfied.

$$D_1>D_2<D_3 \quad (1)$$

$$D_1>D_4<D_3 \quad (6)$$

$$1.0*(D_1+D_2)>D_1>0.6*(D_1+D_2) \quad (10)$$

$$1.0*(D_3+D_4)>D_3>0.65*(D_3+D_4) \quad (30)$$

The reason why the average intervals $D_1$ to $D_4$ are set as described above will now be described.

Figure 5B:
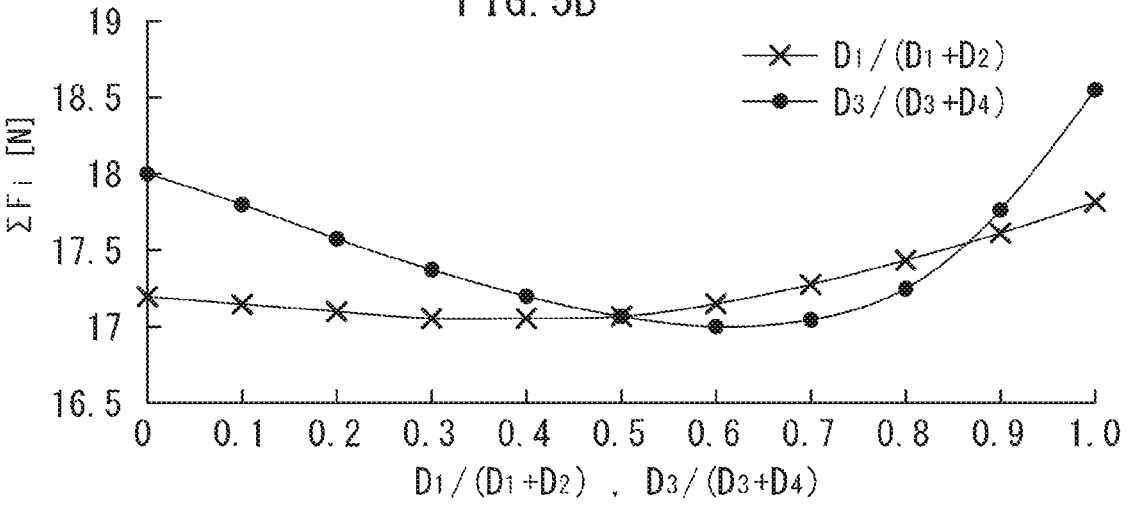
FIG. 5B is a graph showing the relationship between the eyelet arrangement and the fastening force.

FIG. 5B shows the change of the sum $\Sigma F_i$ of fastening forces from the shoelace plotted against $D_1/(D_1+D_2)$ or $D_3/(D_3+D_4)$ varied from 0 to 1.0 on the horizontal axis.

Referring to FIG. 5B, a case where the ratio $D_1/(D_1+D_2)$ is varied will be discussed.

Figure 8A:
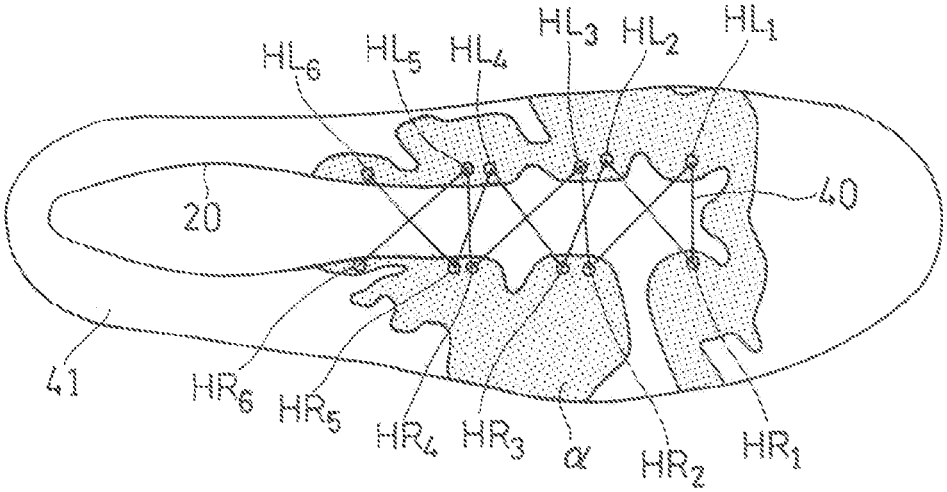

Prior to the discussion, a reinforcement area was determined that is necessary to efficiently transmit the fastening force $F_i$ from the shoelace to the upper. As a result of the calculation, it was found that the area $\alpha$ represented by a dotted pattern of FIG. 8A to FIG. 80 is important for the transmission of the fastening force. Therefore, it can be seen that in the part where the area $\alpha$ expands, i.e., the second eyelet $HL_2$ ($HR_2$) and the third eyelet $HL_3$ ($HR_3$) on the medial side (FIG. 8C), a larger fastening force is needed than at other eyelets. On the other hand, it can be seen that on the lateral side (FIG. 8B), a larger fastening force is needed at the second to fourth eyelets.

Figure 8B:
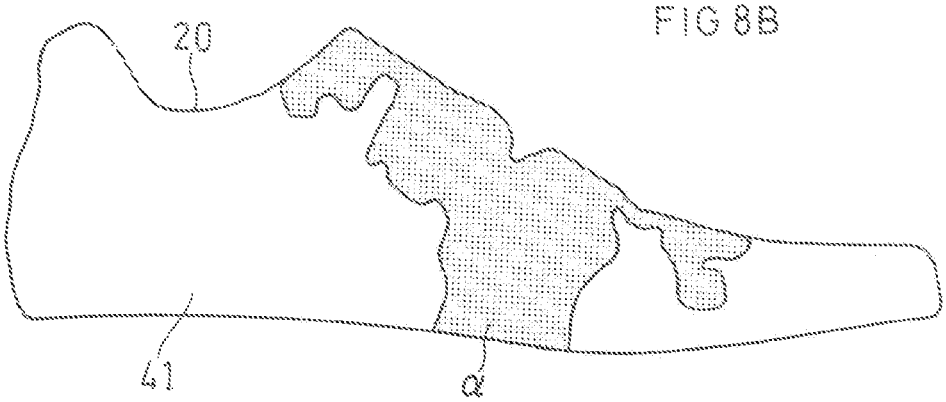
Figure 8C:
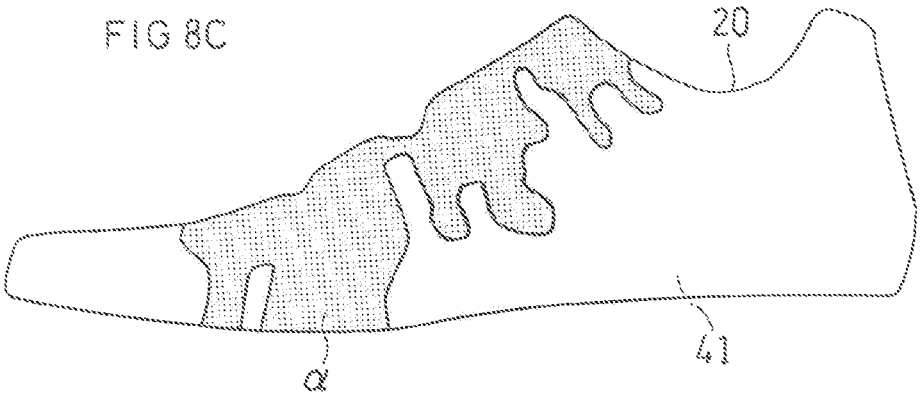

Now, how the area $\alpha$ has been determined as shown in FIG. 8A to FIG. 8C will be discussed.

On the medial side of FIG. 80, the ball of the big toe protrudes outward to create a bracketed area on the medial surface of the first metatarsal bone posterior to the ball of the big toe, leading to a need to fit the upper to the medial surface of the big toe (the first toe) so that the middle foot portion of the upper conforms to the bracketed area.

On the lateral side of FIG. 8B, the lateral surface of the foot forms an inclined, generally flat surface around the second to fourth eyelets while the upper generally forms an outwardly-protruding curved surface. This leads to a need to fit the curved upper to the inclined, generally flat surface of the foot.

Now, in FIG. 5B, when the ratio $D_1/(D_1+D_2)$ becomes close to 0 from 0.4, the sum $\Sigma F_i$ of fastening forces slightly increases. In this case, however, $D_1$ of FIG. 5A decreases, and the second eyelet $HL_2$, $HR_2$ comes closer to the first eyelet $HL_1$, $HR_1$. Now, as shown in FIG. 8A and FIG. 8B, there is no need for a large fastening force in the area around the first eyelets, and it is not preferred that the fastening force is lopsided to the anterior toe side.

Therefore, it is preferred that the ratio $D_1/(D_1+D_2)$ is set to a value that is greater than 0.5. Thus, it is preferred that $D_1 \geq D_2$.

On the other hand, when the ratio $D_1/(D_1+D_2)$ of FIG. 5B comes closer to 1.0 from 0.5, the sum $\Sigma F_i$ increases significantly. Particularly, when the ratio $D_1/(D_1+D_2)$ exceeds 0.6, the sum $\Sigma F_i$ clearly increases significantly.

Therefore, the first average interval $D_1$ and the second average interval $D_2$ preferably satisfy Expression (10) below, and more preferably satisfy Expression (11) below.

$$1.0*(D_1+D_2)>D_1>0.6*(D_1+D_2) \quad (10)$$

$$1.0*(D_1+D_2)>D_1>0.65*(D_1+D_2) \quad (11)$$

In Expressions (10) and (11) above, the value of the ratio $D_1/(D_1+D_2)$ is preferably greater than 0.6, and more preferably greater than 0.65. Note that since $D_2$ takes a value that is greater than 0, the ratio $D_1/(D_1+D_2)$ is a value that is smaller than 1.

Next, in FIG. 5B, a case where the ratio $D_3/(D_3+D_4)$ is varied will be discussed.

When the ratio $D_3/(D_3+D_4)$ comes closer to 0 from 0.5, the sum $\Sigma F_i$ of fastening forces increases. However, this is on the precondition that the second average interval $D_2$ is decreased as described above. Therefore, in FIG. 5A, the second average interval $D_2$ is small and the third average interval $D_3$ is also small. As a result, the ratio $D_3/(D_3+D_4)$ coming close to 0 is not preferred because the fastening force will then excessively localize around the third eyelet $HL_3$, $HR_3$.

Therefore, it is preferred that the ratio $D_3/(D_3+D_4)$ is set to a value that is greater than 0.5. Thus, it is preferred that $D_3>D_4$.

On the other hand, when the ratio $D_3/(D_3+D_4)$ of FIG. 5B comes closer to 1.0 from 0.5, the sum $\Sigma F_i$ starts increasing about when the ratio exceeds 0.65.

Therefore, the relationship between the third average interval $D_3$ and the fourth average interval $D_4$ preferably satisfies Expression (30) below, more preferably satisfies Expression (31) below, and most preferably satisfies Expression (32) below.

$$1.0*(D_3+D_4)>D_3>0.65*(D_3+D_4) \quad (30)$$

$$1.0*(D_3+D_4)>D_3>0.7*(D_3+D_4) \quad (31)$$

$$1.0*(D_3+D_4)>D_3>0.75*(D_3+D_4) \quad (32)$$

In Expressions (30) to (32) above, the value of the ratio $D_3/(D_3+D_4)$ is preferably greater than 0.65, more preferably greater than 0.7, and most preferably greater than 0.75. Note that since the fourth average interval $D_4$ takes a value that is greater than 0, the ratio $D_3/(D_3+D_4)$ is a value that is smaller than 1.

Now, the positions at which the fourth to fifth eyelets are provided typically coincide with the middle foot portion and posterior to the toes. Therefore, there is less foot deformation, and the fourth eyelet $HL_4$ ($HR_4$) and the fifth eyelet $HL_5$ ($HR_5$) can be arranged spaced apart from each other in the foot width direction as shown in FIG. 5A in each of the left and right eyelet rows.

That is, in the case of this example, the fourth eyelet $HR_4$ ($HL_4$) and the fifth eyelet $HR_5$ ($HL_5$) are spaced apart from each other in the foot width direction, and the interval $W_4$ between the fourth eyelet and the fifth eyelet in the foot width direction is greater than the fourth average interval $D_4$. In the case of FIG. 5A, while $D_3/(D_3+D_4)$ is set to be about 0.83, the shoelace can be arranged as shown in FIG. 2.

From the discussion above, it can be seen that the relationship between the second average interval $D_2$ and the fourth average interval $D_4$ satisfies Expressions (8) and (9) below.

$$D_2>D_4 \quad (8)$$

$$(D_2/D_1)>(D_4/D_3) \quad (9)$$

Note that there is no particular limitation on the upper limit of the large average interval a for the small average interval A as long as the shoelace can be arranged by providing the interval $W_i$ (e.g., see $W_4$) in the foot width direction.

Next, the relationship between the eyelet arrangement and the toes will be discussed.

When the tip of the big toe of the foot is raised, the extensor hallucis longus tendon significantly deforms upward. The area where the extensor hallucis longus tendon deforms significantly is directly above the MP joint, and is typically the area where the first eyelet $HL_1$, $HR_1$ of FIG. 5A is arranged or the vicinity thereof.

Therefore, it will be preferred that the first to third eyelets are arranged more coarsely than the third to fifth eyelets as shown in Expression (7) below.

$$(D_1+D_2)>(D_3+D_4) \quad (7)$$

Next, the relationship between the second average interval $D_2$ and the third average interval $D_3$ of FIG. 5A will be discussed.

In light of the relationship between the third average interval $D_3$ and the fourth average interval $D_4$ of FIG. 5B described above, it is presumed that the second average interval $D_2$ and the third average interval $D_3$ preferably differ from each other. On the other hand, since it is preferred that $D_2<D_1$ and $D_3>D_4$, it is preferred that $D_3>D_2$, i.e., $D_3>0.5*(D_2+D_3)$, as shown in FIG. 5A. With such setting, it will be possible to prevent the fastening force from localizing around the third eyelet $HL_3$, $HR_3$.

Moreover, since $\Sigma F_i$ increases as the value of the ratio $D_3/(D_3+D_4)$ of FIG. 5B exceeds 0.6, it is preferred to satisfy Expression (5) below, and it is more preferred to satisfy Expression (50) below.

$$1.0*(D_2+D_3)>D_3>0.6*(D_2+D_3) \quad (5)$$

$$1.0*(D_2+D_3)>D_3>0.65*(D_2+D_3) \quad (50)$$

Note that the setting is such that $D_3/(D_2+D_3)=0.69$ in the example of FIG. 5A.

As shown in FIG. 4 and FIG. 5A, it is preferred that $D_5>D_4$ and $D_5>D_2$ for the same reason as described above.

Since $L_i=R_i$ and $D_i=(L_i+R_i)/2$ as described above, $D_i=L_i=R_i$. Therefore, in the case of this example, the relational expressions (1), . . . , for the average intervals $D_i$ similarly hold true and apply for the eyelet intervals $L_i$ of the left row and for the eyelet intervals $R_i$ of the right row.

Now, since the inclination angles $\theta_{12}$, etc., of FIG. 7A vary depending on the distance in the width direction between left and right eyelets of FIG. 5A. Therefore, variation in the distance in the width direction causes variation in the fastening forces $F_i$. However, the inclination angles $\theta$ themselves are small, and there will be no significant influence on the change of the sum $\Sigma F_i$ itself with respect to the change in the ratio $D_1/(D_1+D_2)$ or the ratio $D_3/(D_3+D_4)$. Thus, there will be no need to take into consideration the distance in the width direction between left and right eyelets.

Next, an example of the specific structure of the upper will be described.

As shown in FIG. 2, the anterior portion of the opening 20 may be covered by a tongue 44, for example. In the case of this example, the shoelace 40 is arranged running over the tongue 44.

In FIG. 2, along the edge of the anterior portion of the opening 20, the upper may be provided with a band-shaped high rigidity member 29 in a generally U-shaped pattern on the central side of the shoe relative to the eyelets. The member may be provided with V-shaped notches 21, 22 and 23 in portions where the interval $L_i$, $R_i$ of FIG. 4 is large.

In FIG. 3, the base fabric of the upper may be a knit or mesh material, or the like, for example. A reinforcement material 43 may be arranged on the base fabric in the area that is represented by a dotted pattern. The eyelets may be formed in the area of the reinforcement material 43.

FIG. 6 and FIG. 8A show other embodiments.

As shown in these figures, the positions of the left and right eyelets may be asymmetric with each other. The number of eyelets may be four on each side or six on each side.

Now, where the left and right eyelet positions are asymmetric with each other as shown in FIG. 6 and FIG. 8A, the sum $\Sigma F_i$ of FIG. 5B may not be directly applicable. However, by obtaining the average intervals D as shown in FIG. 6, the inclination angles 922, etc., of FIG. 7A will be averaged values. That is, with the asymmetric arrangement, if the inclination angle for one of the left and right sides increases, the inclination angle for the other side decreases, thereby canceling out each other, thus resulting in averaged values. Therefore, the value will be approximate to the sum $\Sigma F_i$ of FIG. 5B also when the left and right eyelet positions are asymmetric with each other.

Next, the result of testing the actual foot conformity effect will be described. A foot conformity comparison was performed between an experimental example of this example shown in FIG. 2 and a reference example in which the eyelets were arranged evenly spaced. As a result, it was found that the foot conformity was improved in the experimental example than in the reference example. Particularly, the fit of the upper to the foot was significantly better on the lateral side.

While preferred embodiments have been described above with reference to the drawings, various obvious changes and modifications will readily occur to those skilled in the art upon reading the present specification.

For example, a heel counter that is continuous with the seventh eyelets may be provided in the heel portion.

The tongue in the central portion of the upper may be absent.

The number of eyelets may be four, five or eight or more on each side.

The eyelets may be arranged in an inclined direction along the ridgeline of the instep or may be arranged in the opposite arrangement, in which case the average intervals may be obtained in the longitudinal direction along the ridgeline, etc.

Thus, such changes and modifications are deemed to fall within the scope of the present invention, which is defined by the appended claims.

While the average intervals $D_1$ to $D_4$ are constant with typical structures, the average intervals $D_1$ to $D_4$ inevitably vary slightly depending on the manufacturing process. The differences between average intervals with the present fastening structure is preferably more than that caused by such variations.

INDUSTRIAL APPLICABILITY

The present invention is applicable to shoes having a lacing structure using a shoelace.

REFERENCE SIGNS LIST

20: Opening, 21 to 23: Notches, 29: High rigidity member
40: Shoelace, 41: Upper, 42: Sole, 43: Reinforcement material, 44: Tongue

90: Extensor hallucis longus tendon $D_1$ to $D_5$: First to fifth average intervals $HL_1$ to $HL_n$, $HR_1$ to $HR_n$: Eyelets $L_1$ to $L_5$: Eyelet intervals for left row, $R_1$ to $R_5$: Eyelet intervals for right row $W_4$: Interval in foot width direction $F_1$ to $F_5$: Fastening forces, T: Tension, α: Area

The invention claimed is:

1. A fastening structure of an upper of a shoe, wherein:

the upper defines a left eyelet row and a right eyelet row arranged along a longitudinal direction of the shoe;

the left and right eyelet rows each at least include a first eyelet on a tip side, and a second eyelet, a third eyelet and a fourth eyelet that are arranged in this order from the first eyelet toward a posterior side;

a first average interval $D_1$ is defined as an average value between an interval in the longitudinal direction between the first eyelet and the second eyelet of the left eyelet row and an interval in the longitudinal direction between the first eyelet and the second eyelet of the right eyelet row;

a second average interval $D_2$ is defined as an average value between an interval in the longitudinal direction between the second eyelet and the third eyelet of the left eyelet row and an interval in the longitudinal direction between the second eyelet and the third eyelet of the right eyelet row;

a third average interval $D_3$ is defined as an average value between an interval in the longitudinal direction between the third eyelet and the fourth eyelet of the left eyelet row and an interval in the longitudinal direction between the third eyelet and the fourth eyelet of the right eyelet row; and Expressions (1) and (10) below are satisfied:

$$D_1>D_2<D_3 \quad (1)$$

$$1.0*(D_1+D_2)>D_1>0.6*(D_1+D_2) \quad (10).$$

2. The fastening structure according to claim 1, wherein Expression (11) below is satisfied:

$$1.0*(D_1+D_2)>D_1>0.65*(D_1+D_2) \quad (11).$$

3. The fastening structure according to claim 1, wherein:

the left and right eyelet rows each include a fifth eyelet that is arranged posterior to the fourth eyelet;

a fourth average interval $D_4$ is defined as an average value between an interval in the longitudinal direction between the fourth eyelet and the fifth eyelet of the left eyelet row and an interval in the longitudinal direction between the fourth eyelet and the fifth eyelet of the right eyelet row; and Expression (6) below is satisfied:

$$D_1>D_4<D_3 \quad (6).$$

4. The fastening structure according to claim 3, wherein Expression (7) below is further satisfied:

$$(D_1+D_2)>(D_3+D_4) \quad (7).$$

5. The fastening structure according to claim 3, wherein Expression (8) below is further satisfied:

$$D_2>D_4 \quad (8).$$

6. The fastening structure according to claim 5, wherein Expression (9) below is further satisfied:

$$(D_2/D_1)>(D_4/D_3) \quad (9).$$

7. The fastening structure according to claim 5, wherein Expression (9') below is further satisfied:

$$(D_2/D_1)<(D_4/D_3) \quad (9').$$

8. The fastening structure according to claim 3, wherein the fourth eyelet and the fifth eyelet are spaced apart from each other in a foot width direction, and an interval $W_4$ between the fourth eyelet and the fifth eyelet in the foot width direction is greater than the fourth average interval $D_4$.

9. A shoe comprising:

the fastening structure according to claim 1; and a shoelace inserted through the eyelets of the left and right eyelet rows.

10. The fastening structure according to claim 2, wherein:

the left and right eyelet rows each include a fifth eyelet that is arranged posterior to the fourth eyelet;

a fourth average interval $D_4$ is defined as an average value between an interval in the longitudinal direction between the fourth eyelet and the fifth eyelet of the left eyelet row and an interval in the longitudinal direction between the fourth eyelet and the fifth eyelet of the right eyelet row; and Expression (6) below is satisfied:

$$D_1>D_4<D_3 \quad (6).$$

11. The fastening structure according to claim 10, wherein Expression (7) below is further satisfied:

$$(D_1+D_2)>(D_3+D_4) \quad (7).$$

12. The fastening structure according to claim 10, wherein Expression (8) below is further satisfied:

$$D_2>D_4 \quad (8).$$

13. The fastening structure according to claim 12, wherein Expression (9) below is further satisfied:

$$(D_2/D_1)>(D_4/D_3) \quad (9).$$

14. The fastening structure according to claim 12, wherein Expression (9') below is further satisfied:

$$(D_2/D_1)<(D_4/D_3) \quad (9').$$

15. The fastening structure according to claim 4, wherein the fourth eyelet and the fifth eyelet are spaced apart from each other in a foot width direction, and an interval $W_4$ between the fourth eyelet and the fifth eyelet in the foot width direction is greater than the fourth average interval $D_4$.

16. The fastening structure according to claim 5, wherein the fourth eyelet and the fifth eyelet are spaced apart from each other in a foot width direction, and an interval $W_4$ between the fourth eyelet and the fifth eyelet in the foot width direction is greater than the fourth average interval $D_4$.

* * * * *